US006732700B2

(12) United States Patent
Suganuma

(10) Patent No.: US 6,732,700 B2
(45) Date of Patent: May 11, 2004

(54) OIL PUMP UNIT FOR ENGINE

(75) Inventor: Noboru Suganuma, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 210 days.

(21) Appl. No.: 09/929,458

(22) Filed: Aug. 13, 2001

(65) Prior Publication Data

US 2002/0078917 A1 Jun. 27, 2002

(30) Foreign Application Priority Data

Jun. 12, 2000 (JP) ..... 2000-175655

(51) Int. Cl.[7] ..... F01M 1/00
(52) U.S. Cl. ..... 123/196 R
(58) Field of Search ..... 123/196 R, 195 AC, 123/196 AB, 196 CP, 195 R, 195 C; 184/106

(56) References Cited

U.S. PATENT DOCUMENTS 5,558,549 A 9/1996 Nakase et al.
5,839,930 A 11/1998 Nanami et al.
5,951,343 A 9/1999 Nanami et al.
6,015,320 A 1/2000 Nanami
6,247,904 B1 * 6/2001 Miyazaki et al. ..... 417/310
6,314,934 B1 * 11/2001 Ito et al. ..... 123/196 R
6,478,114 B2 * 11/2002 Ito et al. ..... 184/6.5

* cited by examiner

*Primary Examiner*—Tony M. Argenbright
*Assistant Examiner*—Katrina B. Harris
(74) *Attorney, Agent, or Firm*—Knobbe, Martens, Olson & Bear, LLP

(57) ABSTRACT

An oil pump unit for an engine includes an improved construction. The pump unit includes a housing. A scavenge pump assembly is disposed in series with the feed pump assembly to be driven by the pump shaft. The feed and scavenge pump assemblies each defines end portions spaced apart from each other along the shaft axis. The housing defines a first inlet port and at least one outlet port at one of the end portions of the feed pump assembly, a second inlet port and a second outlet port at one of the end portions of the scavenge pump assembly, and at least a third inlet port at the other end portion of the scavenge pump assembly.

25 Claims, 11 Drawing Sheets

OIL PUMP UNIT FOR ENGINE

RELATED APPLICATION

This application is based on Japanese Patent Application No. 2000-175655, filed on Jun. 12, 2000, the entire contents of which are hereby incorporated by reference.

BACKGROUND OF THE INVENTION

1. Field of the Invention

The present invention relates generally to an oil pump unit for an engine, and more particularly to an improved oil pump unit that varies a volume of its own pumping chamber with rotation.

2. Description of Related Art

Relatively small watercraft such as, for example, personal watercraft have become very popular in recent years. This type of watercraft is quite sporting in nature and carries one or more riders. A hull of the watercraft typically defines a rider's area above an engine compartment. An internal combustion engine powers a jet propulsion unit that propels the watercraft by discharging water rearwardly. The engine lies within the engine compartment in front of a tunnel which is formed on an underside of the hull. The jet propulsion unit is placed within the tunnel and includes an impeller that is driven by the engine.

Typically, the watercraft employs a lubrication system that lubricates portions of the engine. Some lubrication systems form a closed-loop. Such a lubrication system includes an oil tank containing lubricant oil, an oil pan forming a lower wall of a crankcase of the engine to which the lubricant oil that has lubricated the engine portions returns, a feed pump supplying the lubricant oil within the oil tank to the engine portions, and a scavenge pump returning the lubricant oil from the oil pan to the oil tank. Optionally, a trochoid pump construction is applied to the feed and scavenge pumps. Both of the pumps can be unitarily formed within a single housing. For example, respective pump assemblies can be disposed on a common shaft, which is journaled for rotation within the housing and driven by the engine, in series with each other.

In this arrangement, the housing has at least two inlet openings connected to respective inlet ports of the feed and scavenge pumps, and also at least two outlet openings connected to respective outlet ports of the feed and scavenge pumps. Generally, any side surfaces of the housing are available for forming the inlet and outlet openings. The pump unit occasionally is mounted on the engine body because the engine body normally defines both the engines portions which need lubrications and the oil pan therein.

SUMMARY OF THE INVENTION

One aspect of the present invention include the realization that a problem can arise with this arrangement when the pump housing is mounted directly to the engine body such that the internal passages on the housing are connected to internal oil passages in the engine body. In this arrangement, one of the pump which is disposed farther from the engine body than the other pump, necessarily has internal passages that connect the inlet and outlet ports of the pump to the inlet and outlet openings, respectively. The internal passages can produce flow resistance and the pumping ability of the pump is limited to the extent that is regulated by the flow resistance. A larger pump assembly may be useful under a certain engine speed, for example, less than 4,000 rpm to resolve the problem. However, such a larger pump assembly is no longer useful when the engine operates in a high speed range such as, for example, 4,000–7,000 rpm, because the lubricant oil is urged out from pumping chambers of the pump assembly immediately after being drawn into the chambers.

A need therefore exists for an oil pump unit for an engine that offers better performance over a broader range of engine speeds.

In accordance with one another aspect of the present invention, an oil pump unit for an internal combustion engine comprises a housing. A shaft extends within the housing and is journaled thereon for rotation about a shaft axis. The shaft is driven by the engine. An inner rotor is affixed to the shaft to rotate with the shaft. An outer rotor is disposed around the inner rotor to be rotated by the inner rotor. The inner and outer rotors together define at least one pumping chamber. A volume of the pumping chamber varies with the rotation of the inner and outer rotors. The inner rotor has first and second end portions spaced apart from each other along the shaft axis. The outer rotor has third and fourth end portions spaced apart from each other along the shaft axis. The housing defines a first inlet port and at least one outlet port at a location where the first end portion of the inner rotor and the third end portion of the outer rotor are positioned. The first inlet port and the outlet port selectively communicate with the pumping chamber with the rotation of the inner and outer rotors. The housing further defines at least a second inlet port at a location where the second end portion of the inner rotor and the fourth end portion of the outer rotor are positioned.

In accordance with another aspect of the present invention, an oil pump unit for an internal combustion engine comprises a housing. A shaft extends within the housing and is journaled thereon for rotation about a shaft axis. The shaft is driven by the engine. A first pump assembly is disposed on the shaft to be driven by the shaft. A second pump assembly is disposed on the shaft in series with the first pump assembly to be driven by the shaft. The first and second pump assemblies each defines end portions spaced apart from each other along the shaft axis. The housing defines a first inlet port and at least one outlet port at one of the end portions of the first pump assembly, a second inlet port and a second outlet port at one of the end portions of the second pump assembly, and at least a third inlet port at the other end portion of the second pump assembly.

In accordance with a further aspect of the present invention, a lubrication system for an internal combustion engine comprises a first oil reservoir arranged to contain lubricant oil. A second oil reservoir is arranged to receive the lubricant oil that has lubricated portions of the engine. An oil pump unit is arranged to supply the lubricant oil within the first oil reservoir to the portions of the engine and to return the lubricant oil within the second oil reservoir to the primary oil reservoir. The oil pump unit comprises a housing. A shaft extends within the housing and is journaled thereon for rotation about a shaft axis. The shaft is driven by the engine. A feed pump assembly is disposed on the shaft to be driven by the shaft. A scavenge pump assembly is disposed on the shaft in series with the feed pump assembly to be driven by the shaft. The feed and scavenge pump assemblies each defines end portions spaced apart from each other along the shaft axis. The housing defines a first inlet port and a first outlet port at one of the end portions of the feed pump assembly, a second inlet port and a second outlet port at one of the end portions of the scavenge pump assembly, and at least a third inlet port at the other end portion of the scavenge pump assembly.

BRIEF DESCRIPTION OF THE DRAWINGS

These and other features, aspects and advantages of the present invention will now be described with reference to the drawings of preferred embodiments which are intended to illustrate and not to limit the invention. The drawings comprise 13 figures.

DETAILED DESCRIPTION OF THE PREFERRED EMBODIMENTS OF THE INVENTION

Figure 1:
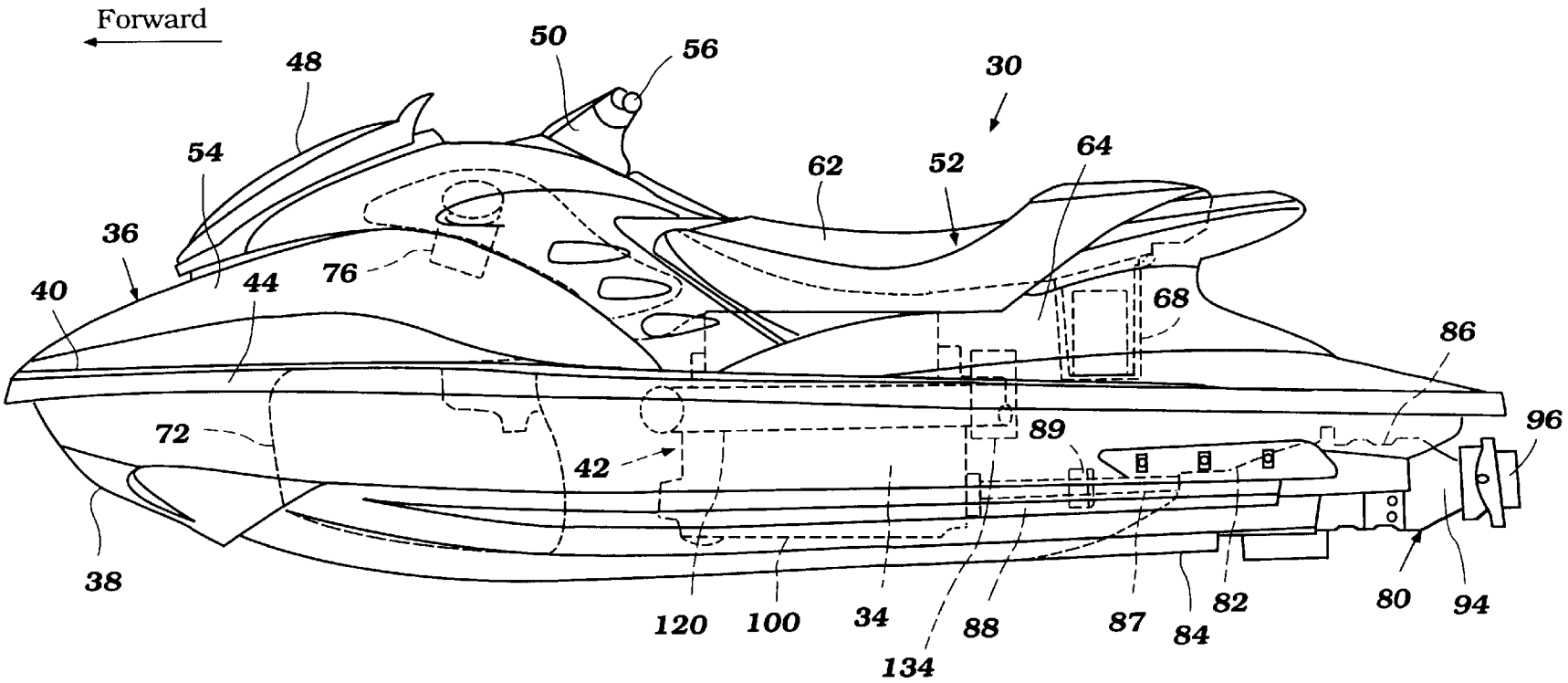
FIG. 1 is a side elevational view of a personal watercraft including an oil pump unit for an engine of the watercraft that is configured in accordance with a preferred embodiment of the present invention.

FIGS. 1–7 illustrate an overall construction of a personal watercraft 30 which employs an oil pump unit 32 (FIG. 6) for an engine 34 of the watercraft 30 that is configured in accordance with a preferred embodiment of the present invention. The oil pump unit 32 has particular utility in the context of a marine drive, such as the personal watercraft 30 for instance, and thus is described in the context of a personal watercraft 30. The oil pump 32, however, can be used with other types of watercrafts or marine drives (i.e., jet boats, outboard motors, inboard/outboard motors, etc.) and also certain land vehicles, which includes lawnmowers, motorcycles, go carts, all terrain vehicles and the like. Furthermore, the oil pump unit 32 can be used for a stationary engine as will become apparent to those of ordinary skill in the art.

The personal watercraft 30 includes a hull 36 formed with a lower hull section 38 and an upper hull section or deck 40. Both the hull sections 38, 40 are made of, for example, a molded fiberglass reinforced resin or a sheet molding compound. The lower hull section 38 and the upper hull section 40 are coupled together to define an internal cavity 42. An intersection of the hull sections 38, 40 is defined in part along an outer surface gunnel or bulwark 44. The hull 36, and in particular, the internal cavity or "engine compartment" 42, houses the engine 34 that powers the watercraft 30.

Figure 2:
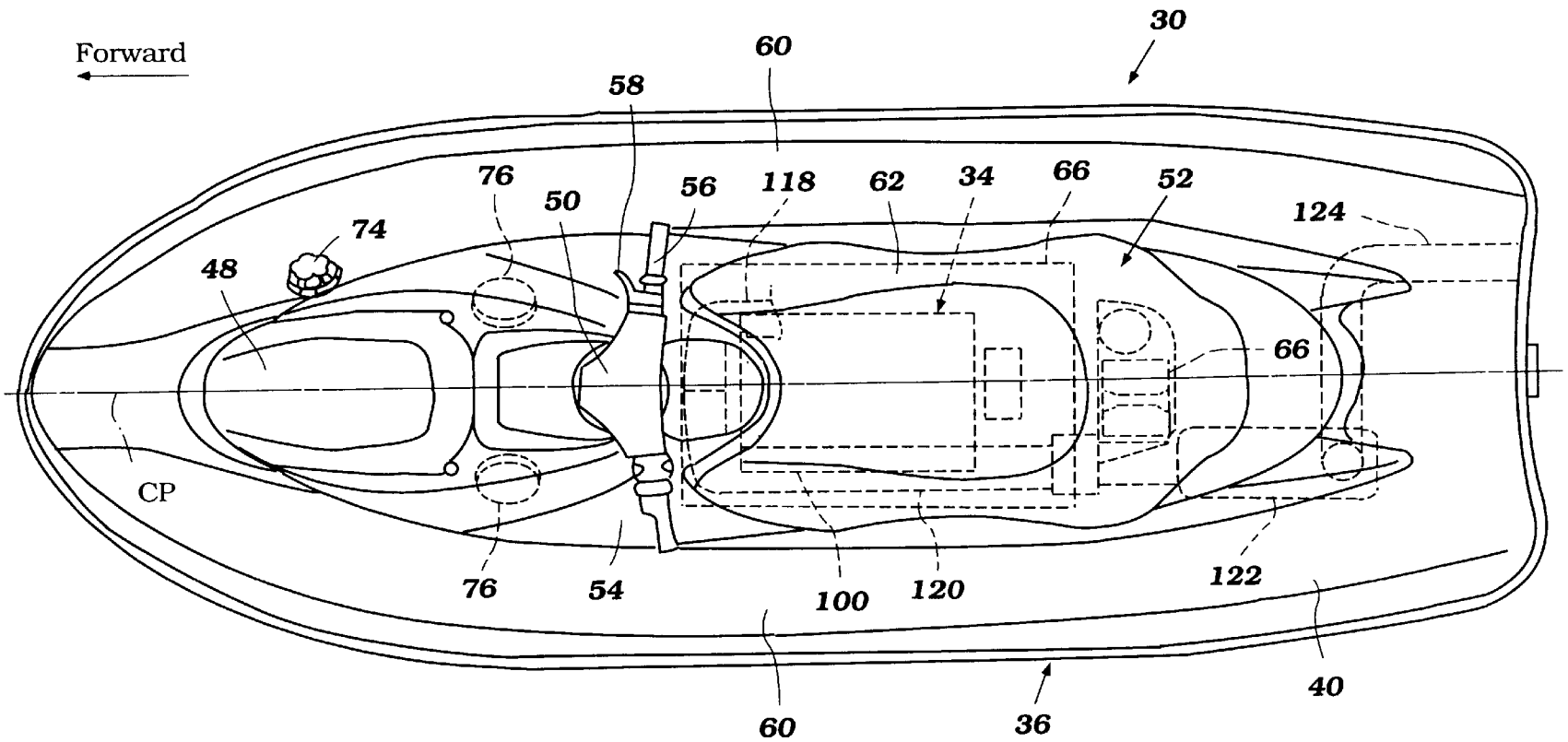
FIG. 2 is a top plan view of the watercraft of FIG. 1.

As shown in FIG. 2, the hull 36 defines a center plane CP that extends generally vertically from bow to stern and along a longitudinal axis of the watercraft 30, when the watercraft 30 is resting in a normal upright position. Along the center plane CP, the upper hull section 36 includes a hatch cover 48, a steering mast 50 and a seat 52 one after another from fore to aft.

In the illustrated embodiment, a bow portion 54 of the upper hull section 40 slopes upwardly rearwardly and an opening (not shown) is provided through which the rider can access a front portion of the internal cavity 42. The bow portion 54 preferably is formed with a pair of cover member pieces which are split another along the center plane CP. The hatch cover 48 is hinged to open or detachably affixed to the bow portion 54 to cover the opening.

The steering mast 50 extends generally upwardly toward the top of the bow portion 54 to support a handle bar 56. The handle bar 56 is provided primarily for a rider to control the steering mast 50 so as to turn the watercraft 30 in a known manner. The handle bar 56 also carries control devices such as, for example, a throttle lever 58 (FIG. 2) for operating throttle valves of the engine 34.

The seat 52 extends fore to aft along the center plane CP at a location behind the steering mast 50. The seat 52 is configured generally as a saddle shape so that the rider can straddle it. Foot areas 60 (FIG. 2) are defined on both sides of the seat 52 and at the top surface of the upper hull section 40. The foot areas 60 are formed generally flat.

A seat cushion 62, which has a rigid backing and is supported by a pedestal section 64 of the upper hull section 40, forms a portion of the seat 52. The pedestal section 64 forms the other portion of the seat 52. The seat cushion 62 is detachably affixed to the pedestal section 64.

An access opening 66 (FIG. 2) is defined on the top surface of the pedestal section 64, under the seat cushion 62, through which the rider can access a rear portion of the internal cavity 42, i.e., an engine compartment. In other words, the seat cushion 62 usually closes the access opening 66. In the illustrated embodiment, the upper hull section 40 also defines a storage box 68 under the seat 52. It is to be noted that the engine compartment can be the whole internal cavity 42 or it can be divided into one or more areas by one or more bulkheads (not shown).

A fuel tank 72 is placed in the internal cavity 42 under the bow portion 54 of the upper hull section 40. The fuel tank 72 is coupled with a fuel inlet port positioned atop the upper hull section 40 through a fuel duct. A closure cap 74 (FIG. 2) closes the fuel inlet port. The opening disposed under the hatch cover 48 is available for accessing the fuel tank 72.

A pair of air or ventilation ducts 76 is provided on both sides of the bow portion 54 so that the ambient air can enter the internal cavity 42 through the ducts 76. Except for the air ducts 76, the internal cavity 42 is substantially sealed to protect the engine 34, a fuel supply system including the fuel tank 72 and other systems or components from water. Optionally, the watercraft 30 can include other air ducts (not shown).

The engine 34 preferably is placed within the engine compartment 42 and generally under the seat 52, although other locations are also possible (e.g., beneath the steering mast 50 or in the bow). The rider can access the engine 34 through the access opening 66 by detaching the seat cushion 62 from the pedestal section 64.

A jet pump assembly 80 propels the watercraft 30. The jet pump assembly 80 is mounted in a tunnel 82 formed on the underside of the lower hull section 38. Optionally, a bulkhead can be disposed between the tunnel 82 and the engine 34.

The tunnel 82 has a downward facing inlet port 84 opening toward the body of water. A jet pump housing 86 is disposed within a portion of the tunnel 82 and communicates with the inlet port 84. An impeller is journaled within the jet pump housing 86.

Figure 5:
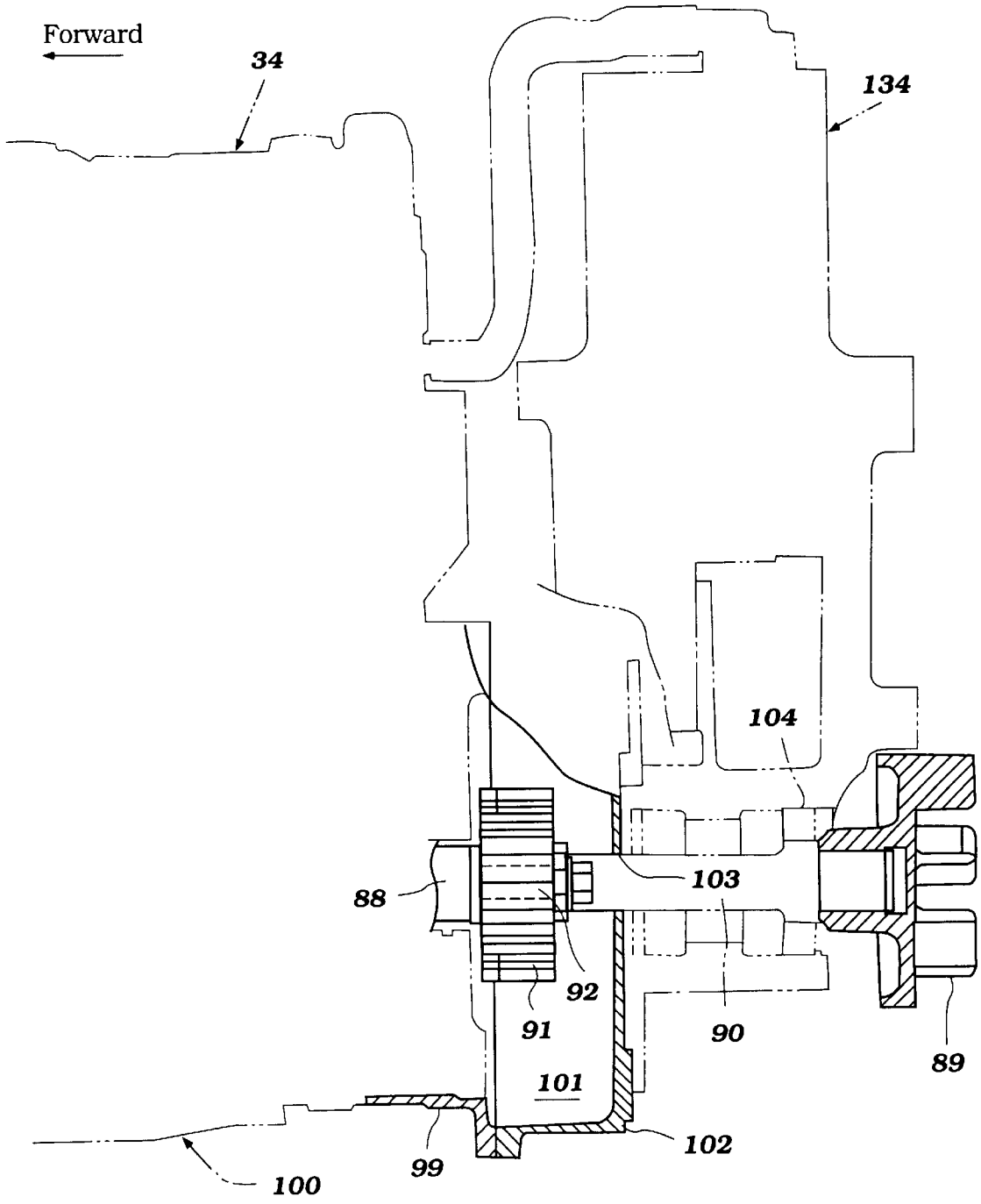
FIG. 5 is a side elevational view of a rear portion of the engine. The forward portion of the engine and an oil tank are shown in phantom line. A transmission and a gear housing are partially shown in section.
Figure 6:
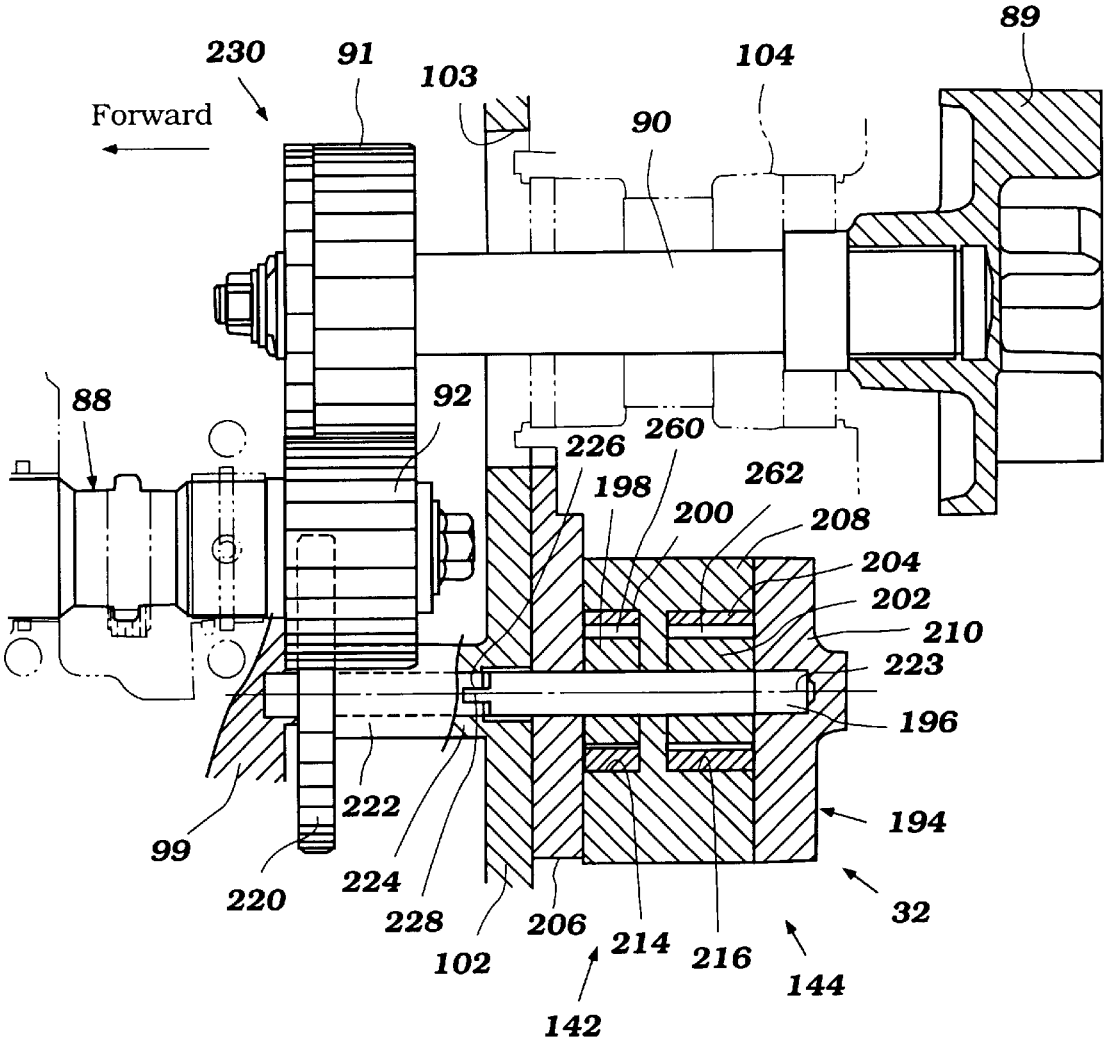
FIG. 6 is a top plan and partial sectional view of the transmission construction and the oil pump unit shown in FIG. 5. The transmission, the oil pump unit and a portion of the engine body are shown in section. The oil pump unit in this figure is illustrated schematically.

An impeller shaft 87 extends forwardly from the impeller and is coupled with a crankshaft 88 of the engine 34 by a coupling member 89 to be driven by the crankshaft 88. More specifically, as shown in FIGS. 5 and 6, the coupling member 89 preferably is affixed to one end of an intermediate shaft 90 that has a reduction gear 91 on the other end thereof. The crankshaft 88 also has an output gear 92 that meshes with the reduction gear 91 at a rear end of the crankshaft 88 to rotate the intermediate shaft 90. Because a diameter of the reduction gear 91 is greater than a diameter of the output gear 92, the intermediate shaft 90 rotates in a reduced speed that is slower than an engine speed made by the crankshaft 88.

With reference to FIG. 1, the rear end of the jet pump housing 86 defines a discharge nozzle 94. A deflector or steering nozzle 96 is affixed to the discharge nozzle 94 for pivotal movement about a generally vertical steering axis. A cable connects the deflector 96 with the steering mast 50 so that the rider can steer the deflector 96.

When the crankshaft 88 of the engine 34 drives the impeller shaft 88 and hence the impeller rotates, water is drawn from the surrounding body of water through the inlet port 84. The pressure generated in the jet pump housing 86 by the impeller produces a jet of water that is discharged through the discharge nozzle 94 and the deflector 96. The water jet thus produces thrust to propel the watercraft 30. The rider can steer the deflector 96 with the handle bar 56 of the steering mast 50 so as to turn the watercraft 30.

The engine 34 preferably operates on a four-cycle combustion principle and preferably has four cylinders spaced apart from one another along the center plane CP. The engine 34 can have a typical and conventional four-cycle engine construction. That is, the engine 34 includes a cylinder block 98 (FIG. 4) defining four cylinder bores in which pistons reciprocate. At least one cylinder head member is affixed to the upper end of the cylinder block 98 to close respective upper ends of the cylinder bores and defines combustion chambers with the cylinder bores and the pistons. Separate cylinder head members for each cylinder bore also can be used.

A crankcase member 99 (FIGS. 4–6) also is affixed to the lower end of the cylinder block 98 to close the respective lower ends of the cylinder bores and to define a crankcase chamber with the cylinder block 98. The crankshaft 88 is journaled for rotation on bearings within the crankcase chamber and is rotatably connected to the pistons through connecting rods. The cylinder block 98, the cylinder head and the crankcase member 99 preferably are made of aluminum alloy and together define an engine body 100. The illustrated engine 34, however, merely exemplifies one type of engine. Other types of engines having other number of cylinders, other cylinder arrangements (V-type and W-type) and operating on other combustion principles (e.g., two-cycle, rotary, diesel) all are applicable.

Figure 7:
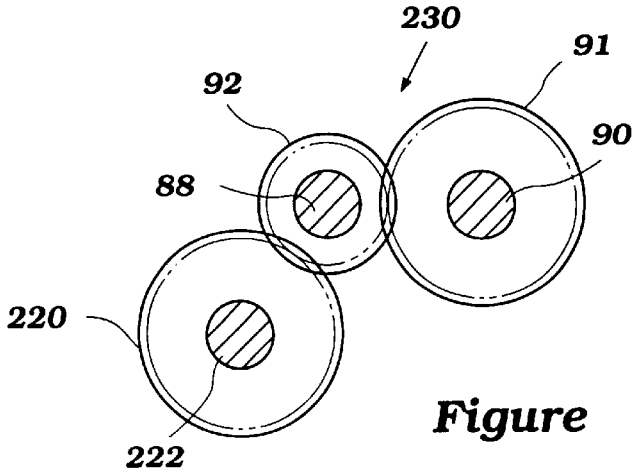
FIG. 7 is a schematic rear view of a gear train of the transmission.

With referende to FIGS. 5–7, the reduction and output gears 91, 92 preferably are positioned within a gear chamber 101 defined within a gear housing 102 which is affixed at a rear end of the crankcase member 99. The intermediate shaft 90 extends generally horizontally through an opening 103 of the gear housing 102 toward the impeller shaft 87. A seal member can provide a water-tight seal at the opening 103. An external portion of the intermediate shaft 90 is journaled on bearings 104 mounted to the engine body 100.

Engine mounts 105 (FIGS. 3 and 4) extend from both sides of the engine body 100. The engine mounts 105 preferably include resilient portions made of, for example, a rubber material. The engine body 100 is mounted on the lower hull section 38 (or possibly on the hull liner) by the engine mounts 105 so that vibration of the engine body 100 is inhibited from conducting to the hull section 38.

The engine 34 comprises an air induction system, a fuel supply system, an ignition system and an exhaust system, although other systems can optionally be provided. The air induction system is arranged to introduce air to the combustion chambers. Throttle valves preferably are provided to regulate the air or measure an amount of the air passing through the induction system.

In the illustrated embodiment, a plenum chamber assembly 108 (FIGS. 3 and 4) is provided to collect and filter induction air and to reduce intake noise. The plenum chamber assembly 108 preferably is mounted on the engine body 100. Throttle bodies journaling the throttle valves for pivotal movement preferably are housed within the plenum chamber assembly 108.

The fuel supply system is arranged to supply fuel to the combustion chambers within the engine body 100. A port injected or indirect fuel injection device preferably is employed to spray the fuel into intake ports of the induction system under control of a control device such as, for example, an ECU (Electronic Control Unit) (not shown). Preferably, initiation timing and duration of the injections are controlled by the ECU. A direct fuel injection system that sprays fuel directly into the combustion chambers of course can replace the port injection device. Moreover, other fuel charge forming devices such as, for example, a carburetor assembly can be used instead of the fuel injection system.

The ignition system is arranged to fire air/fuel charges in the combustion chambers at controlled ignition timings. The ECU preferably controls the ignition timings also.

The exhaust system is arranged to guide exhaust gases from the combustion chambers to a location outside of the watercraft 30. In the illustrated embodiment, the exhaust gases are discharged to the tunnel 82 through a plurality of exhaust manifolds, conduits and/or devices 112–124, described in greater detail below.

A large part of the respective constructions and arrangements of the foregoing systems are well known to those of ordinary skill in the art. A co-pending U.S. patent application filed Jan. 17, 2001, titled ENGINE FOR WATERCRAFT, which serial number is Ser. No. 09/765,052, and also a co-pending application filed Jul. 31, 2001, titled FOUR-CYCLE ENGINE, disclose exemplary constructions and arrangements, the entire contents of which are hereby expressly incorporated by reference.

Figure 3:
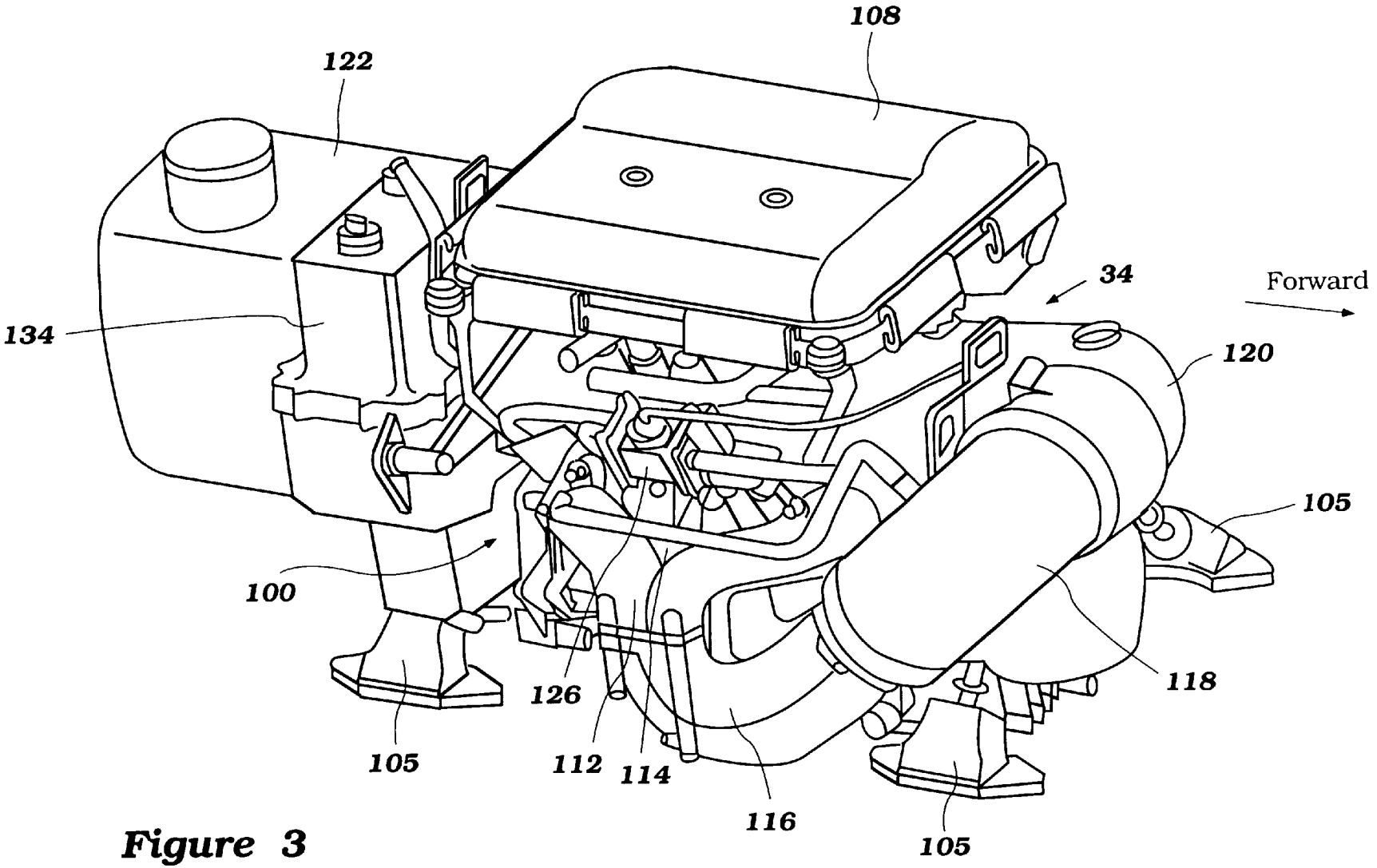
FIG. 3 is a front, top and starboard side perspective view of the engine shown in FIG. 1.

As shown in FIG. 3, first and second exhaust manifolds 112, 114 depend from the cylinder head member at a starboard side surface thereof. The exhaust manifolds 112, 114 define outer exhaust passages that are coupled with inner exhaust passages defined within the cylinder head member to collect exhaust gases from the respective inner exhaust passages. More specifically, the first exhaust manifold 112 has a pair of end portions spaced apart from each other with a length that is equal to a distance between the forward-most inner exhaust passage and the rear-most inner exhaust passage. The end portions are connected with the forward-most and rear-most exhaust passages. The second exhaust manifold 114 also has a pair of end portions spaced apart from each other with a length that is equal to a distance between the other two or in-between exhaust passages. The end portions of the second exhaust manifold 114 are connected with the in-between exhaust passages. The exhaust manifolds 112, 114 extend slightly downwardly. Respective downstream ends of the first and second exhaust manifolds exist closely with one another and are coupled with an upstream end of a first unitary exhaust conduit 116.

Figure 4:
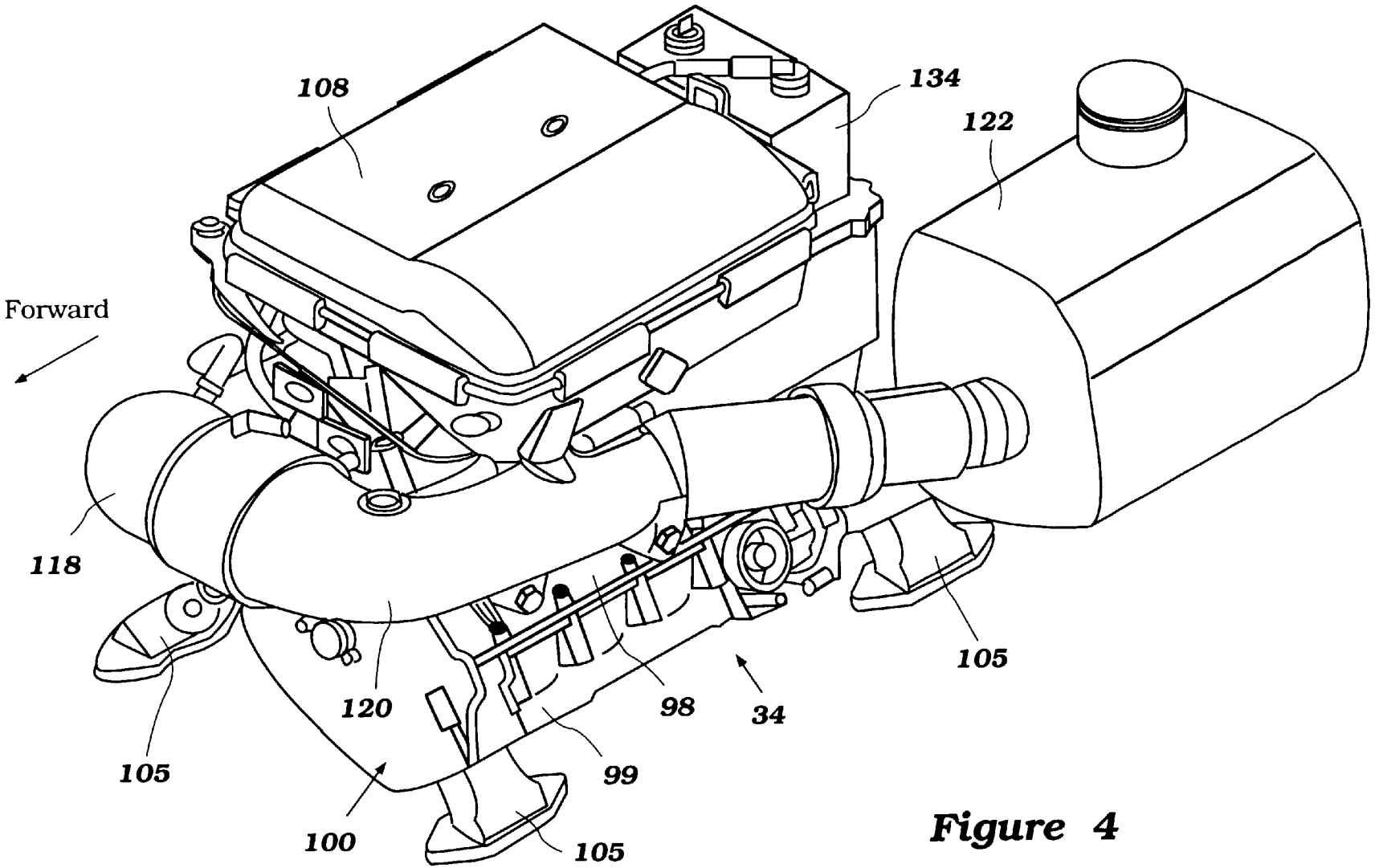
FIG. 4 is a front, top, and port side perspective view of the engine shown in FIG. 1.

The first unitary conduit 116 extends further downwardly and then upwardly as it extends forwardly and in a downstream direction of the exhaust system. A downstream end of the first unitary conduit 116 is coupled with an upstream end of a second unitary exhaust conduit 118. The second unitary conduit 118 extends further upwardly and then transversely to end in front of the engine body 100. As shown in FIG. 4, the second unitary conduit 118 is coupled with an exhaust pipe 120 on the front side of the engine body 100. The coupled portions thereof preferably are supported by a front surface of the engine body 100. The exhaust pipe 120 extends rearwardly along a side surface of the engine body 100 on the port side and then is connected to an exhaust silencer or water-lock 122 at a forward surface of the exhaust silencer 122.

With reference to FIG. 2, the exhaust silencer 122 preferably is placed at a location generally behind the engine body 100 but in a half space on the port side and is secured to the lower hull section 38 (or possibly to a hull liner). A discharge pipe 124 extends from a top surface of the exhaust silencer 122 and transversely across the center plane CP to the other half space on the starboard side. The discharge pipe 124 then extends rearwardly and opens at the tunnel 82 and thus to the exterior of the watercraft 30 in a submerged position. The exhaust silencer 122 has one or more expansion chambers to reduce exhaust noise and also to inhibit water in the discharge pipe 124 from entering the exhaust pipe 120 when the watercraft 30 capsizes because of its construction and arrangement as is well known.

As shown in FIG. 3, the exhaust system preferably is provided with a secondary air delivery device 126 that can purify the exhaust gases by oxidation reaction with oxygen that is supplied to the exhaust system through the device 126.

The watercraft 30 preferably employs a cooling system for the engine 34 and the exhaust system. Preferably, the cooling system is an open-loop type and includes a water pump and a plurality of water jackets and/or conduits. In the illustrated embodiment, the jet pump assembly 80 is used as the water pump with a portion of the water pressurized by the impeller being drawn off for the cooling system, as known in the art.

The engine body 100 and the respective exhaust manifolds and conduits 112–120 preferably define the water jackets. Both portions of the water to the water jackets of the engine body 100 and to the water jackets of the exhaust system can flow through either common channels or separate channels formed within one or more exhaust manifolds and conduits 112–120 or external water pipes. The illustrated exhaust manifolds and conduits 112–120 preferably are formed as dual passage structures in general.

With primary reference to FIGS. 6–11 and continued reference to FIGS. 3–5, a preferred construction and arrangement of a lubrication system 130 that includes the oil pump unit 32 is described below.

Figure 8:
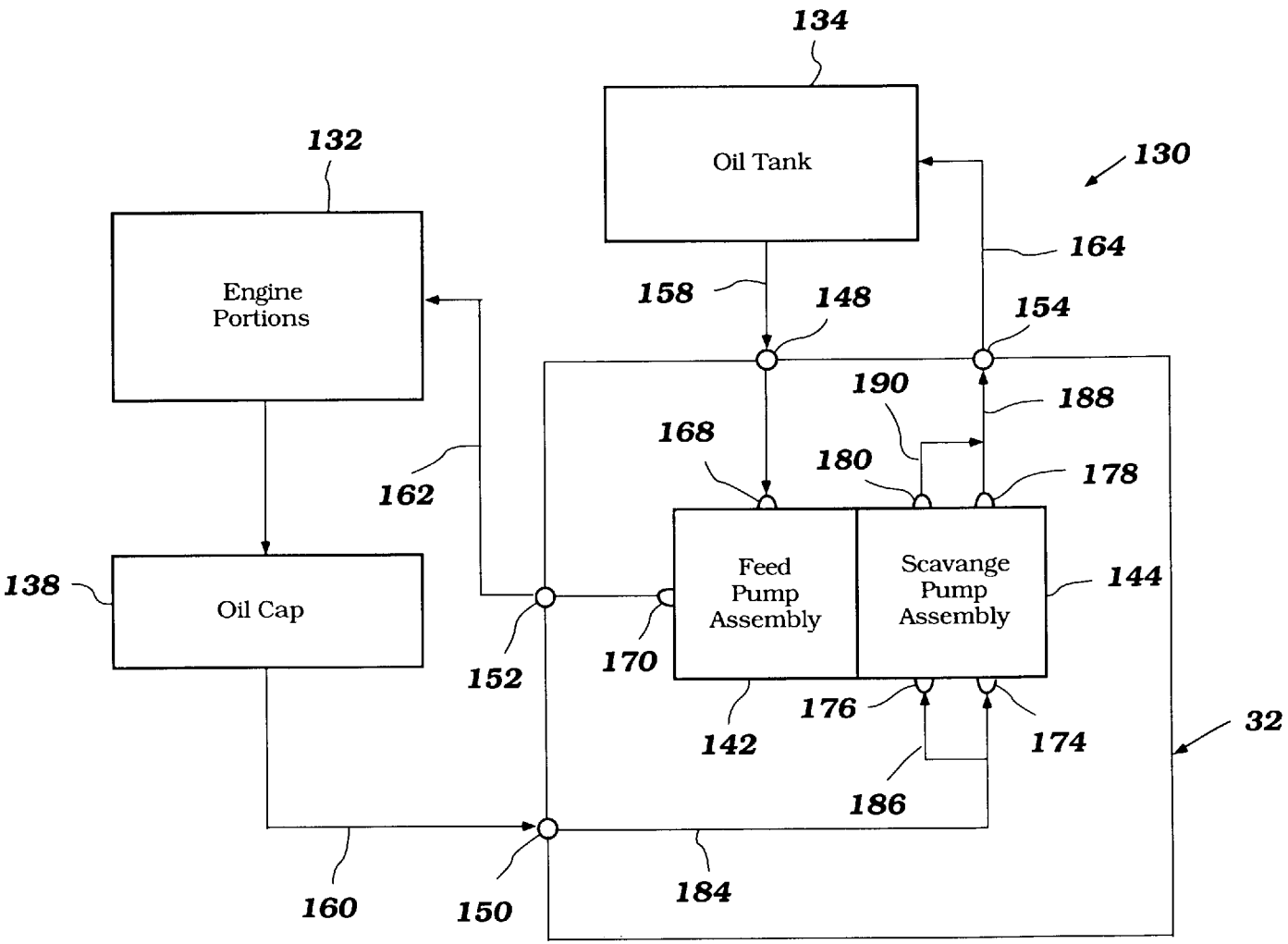
FIG. 8 is a flow chart a lubrication system incorporating the oil pump unit and arranged in accordance with the preferred embodiment of the present invention.

FIG. 8 illustrates a block diagram schematically showing the lubrication system 130. The lubrication system 130 is employed for delivering lubricant oil to engine portions 132 that benefit from lubrication and for collecting the oil for recirculation. The engine portions 132 includes, for example, coupling portions of the crankshaft 88, pistons, connecting rods and respective bearings as is well known to those of ordinary skill in the art. The illustrated lubrication system 130 is a closed-loop, dry-sump type, although other types can of course be applied.

The lubrication system 130 preferably comprises an oil tank or primary oil reservoir 134 and an oil cap or temporary oil reservoir 138 other than the oil pump unit 32. As shown in FIGS. 3–5, the oil tank 134 preferably is configured as a rectangular parallelepiped reservoir for storing lubricant oil. The oil tank 134 is disposed, for example, on a rear side of the engine body 100 and is mounted on the engine body 100 or directly affixed to the lower hull section 38. The oil cap 138 is formed at a bottom of the crankcase chamber that is defined by the crankcase member 99. That is, the oil cap 138 is located under the engine portions 132 in the engine body 100.

As schematically shown in FIG. 6, the oil pump unit 32 is mounted on the gear housing 102 adjacent to the bearings 104 on which the intermediate shaft 90 of the coupling member 89 is journaled. The oil pump unit 32 comprises a feed pump assembly 142 and a scavenge pump assembly 144.

With reference to FIG. 8, the oil pump unit 32 preferably has two inlet openings 148, 150 and two outlet openings 152, 154. The inlet opening 148 is connected with the oil tank 134 through a supply passage 158, while the inlet opening 150 is connected with the oil cap 138 through an external scavenge passage 160. The outlet opening 152 in turn is connected with the engine portions 132 through one or more delivery passages 162, while the outlet opening 154 is connected with the oil tank 134 through an external return passage 164.

Internally, the feed pump assembly 142 preferably has an inlet port 168 connected with the inlet opening 148 and an outlet port 170 connected with the outlet opening 152. The scavenge pump assembly 144 in turn advantageously has a pair of inlet ports 174, 176 and a pair of outlet ports 178, 180. The inlet port 174 is connected with the inlet opening 150 through an internal scavenge passage 184, while the inlet port 176 also is connected with the inlet opening 150 through a branch passage 186 and then through the scavenge passage 184. The outlet port 178 in turn is connected with the outlet opening 154 through an internal return passage 188, while the outlet port 180 also is connected with the outlet opening 154 through a branch passage 190 and then through the return passage 188.

Figure 10:
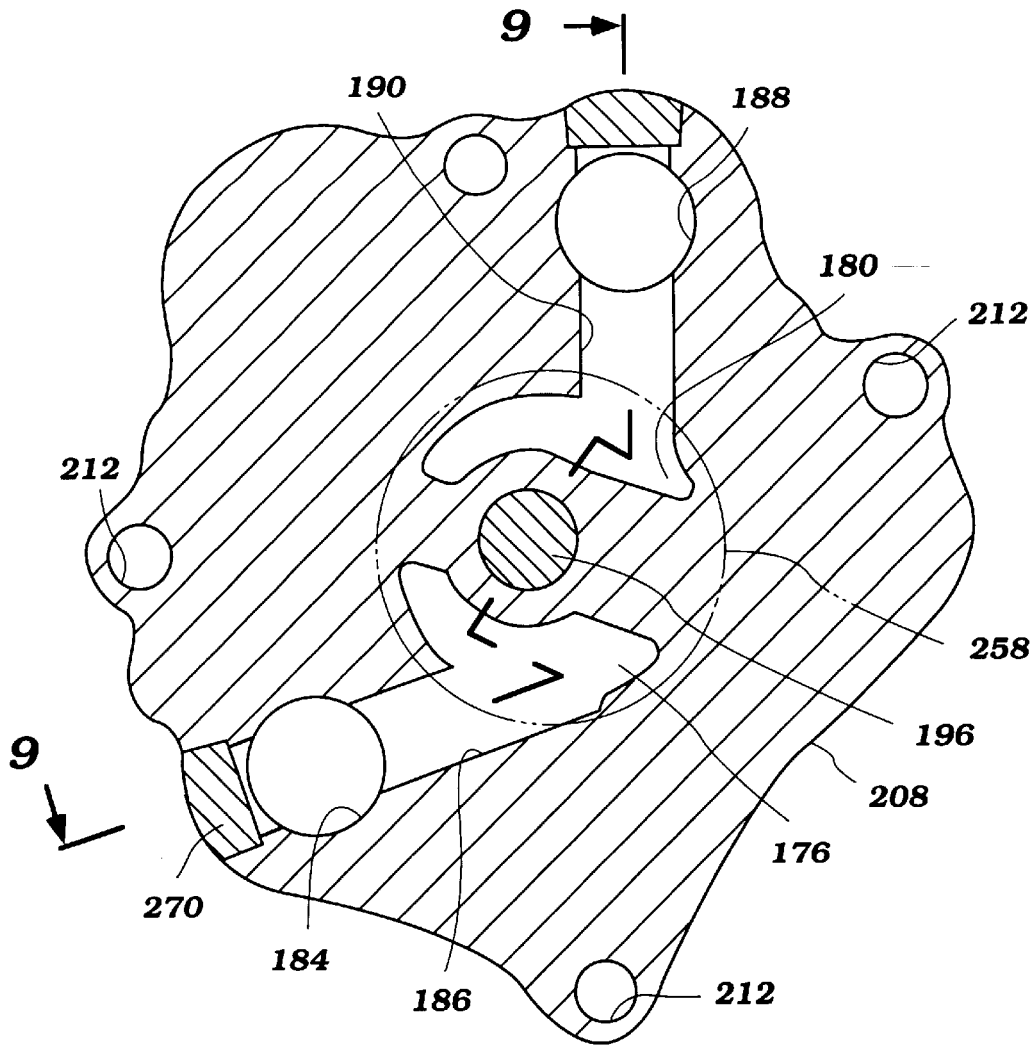
FIG. 10 is a sectional view of the oil pump taken along the line 10—10 of FIG. 9.

With primary reference to FIGS. 6 and 8, the oil pump unit 32 preferably comprises a housing 194, a pump shaft 196, inner and outer feed pump rotors 198, 200, and inner and outer scavenge pump rotors 202, 204. The housing 194 preferably comprises first, second and third housing members 206, 208, 210 which are coupled together by through bolts. FIG. 10 shows bolt holes 212 for the bolts. Preferably, the first or front housing member 206 has flanges (not shown) to be affixed to the gear housing 102 by bolts. The second or middle housing member 208 forms a feed pump space 214 and a scavenge pump space 216. The inner and outer feed pump rotors 198, 200 have respective end portions axially spaced apart from each other and are disposed within the feed pump space 214, while the inner and outer scavenge pump rotors 202, 204 also have end portions axially spaced apart from each other and are disposed within the scavenge pump space 216. The pump shaft 196 extends generally horizontally within the housing 194 in parallel to the intermediate shaft 90 and is journaled on the front and rear housing members 206, 210. The pump shaft 196 preferably has a uniform diameter throughout.

The pump shaft 196 is driven by the crankshaft 88. In the illustrated embodiment, a pump gear 220 meshes with the output gear 92 of the crankshaft 88 on an opposite side to the reduction gear 91, and a pump gear shaft 222 of the pump gear 220 is coupled with the pump shaft 196. An axis 223 of the pump gear shaft 222 is coincident with an axis of the pump shaft 196.

The gear housing 102 has a cylindrical bearing portion 224 in which the pump gear shaft 222 extends to be journaled thereon. The pump gear shaft 222 has a coupling recess 226 at a rear end thereof, while the pump shaft 196 has a coupling projection 228 that fits in the coupling recess 226. The pump shaft 196 thus rotates together with the pump gear shaft 222 which is driven by the crankshaft 88 through the meshed output gear 92 and the pump gear 220.

As shown in FIGS. 6 and 7, the output gear 92, the reduction gear 91 and the pump gear 220 together form a gear train 230. Because a diameter of the pump gear 220 is greater than the diameter of the output gear 92 and is generally equal to the diameter of the reduction gear 91, the pump gear shaft 222 and the pump shaft 196 rotates slower than the crankshaft 88 and can be approximately the same speed as the intermediate shaft 90.

Figure 9:
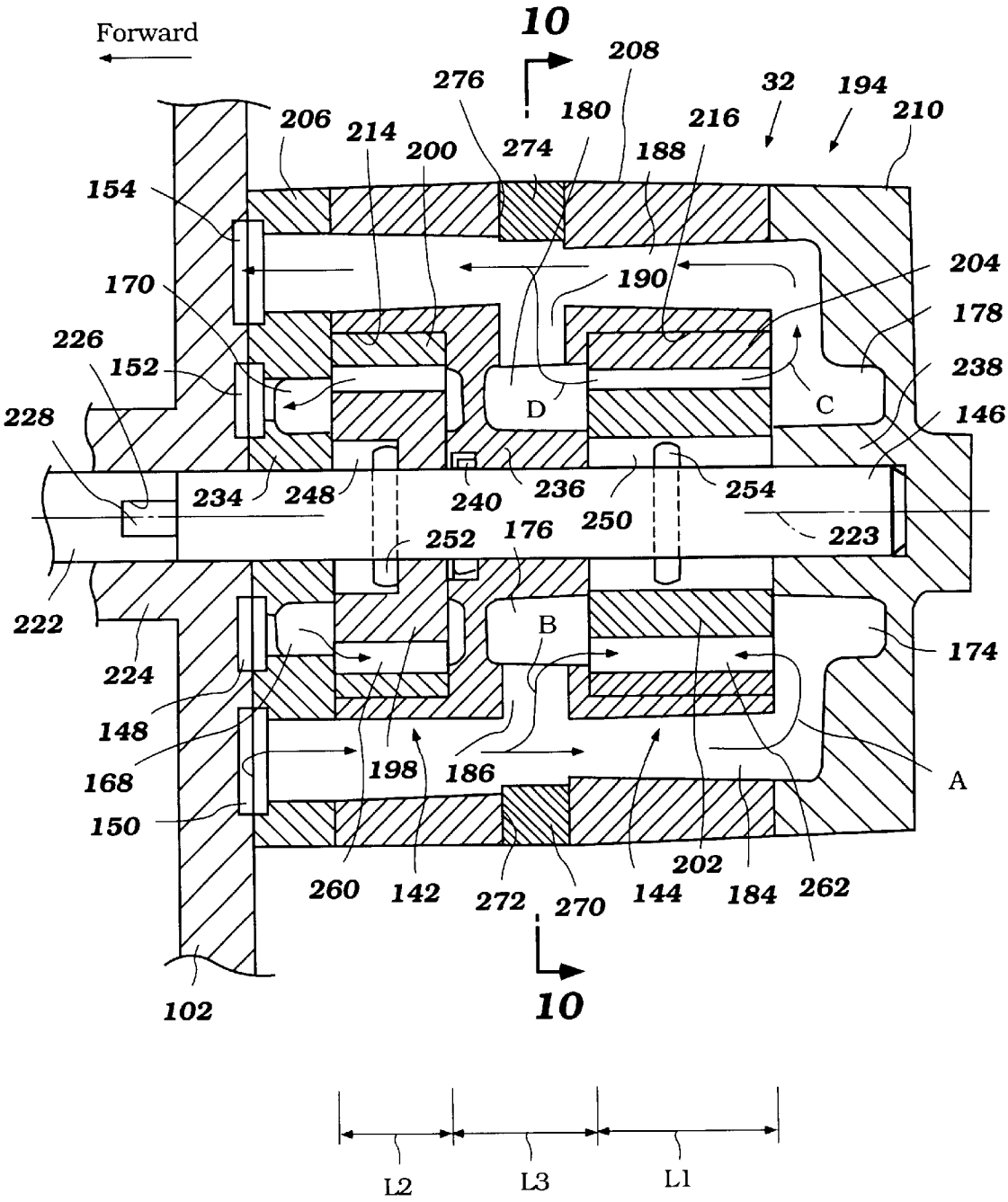
FIG. 9 is a sectional view of the oil pump unit taken along the line 9—9 of FIG. 10.

With reference to FIGS. 9 and 10, the pump shaft 196 preferably is journaled on bearing portions 234, 236, 238 of the front, middle, and rear housing members 206, 208, 210, respectively. The illustrated feed and scavenge pump spaces 214, 216 are formed in series with each other on the pump shaft 196. In other words, the scavenge pump space 216 is spaced apart from the feed pump space 214 along the axis 223 of the pump shaft 196. Preferably, the feed pump space 214 is disposed closer to the gear housing 102, i.e., the engine body 100. A seal member 240 is provided around the pump shaft 196 between the feed and scavenge pump spaces 214, 216 to liquid-tightly separate both the spaces 214, 216.

The inner and outer rotors 198, 200 together define the feed pump assembly 142 with the pump shaft 196 and the middle housing member 208, while inner and outer rotors 202, 204 together define the scavenge pump assembly 144 also with the pump shaft 196 and the middle housing member 208. In the illustrated embodiment, both the feed and scavenge pump assemblies 142, 144 have a typical trochoid pump construction.

Figure 11:
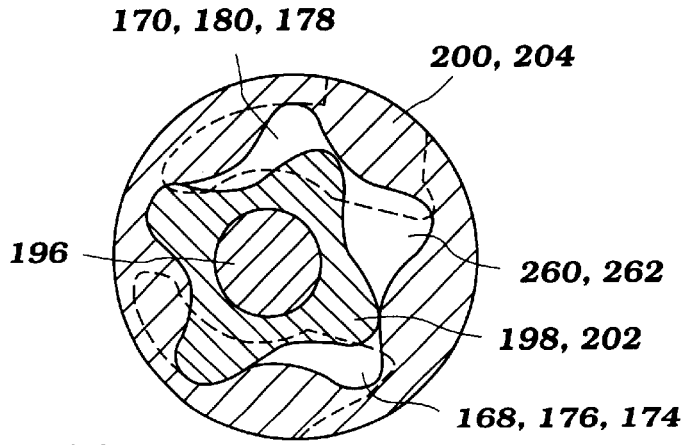
FIG. 11 is a schematic view of a typical trochoid pump construction that is applied to feed and scavenge pump assemblies in the pump unit.

As schematically shown in FIG. 11, the respective inner rotors 198, 202 preferably have four teeth and affixed to the pump shaft 196 to rotate together with the pump shaft 196. As shown in FIG. 9, the pump shaft 196 defines key ways 248, 250 positioned at the feed and scavenge pump spaces 214, 216. Keys 252, 254 coupled with the pump shaft 196 engage with the respective key ways 248, 250 to rotate the inner rotors 198, 202 with the pump shaft 196. The outer rotors 200, 204 are disposed around the inner rotors 198, 202. The respective outer rotors 200, 204 define five recesses in which the teeth of the inner rotors 198, 202 are engageable. FIG. 10 shows an outer surface of the outer rotors 200, 204 with a phantom line 258. As shown in FIGS. 10 and 11, the pump shaft 196 is slightly offset from a center axis of the outer rotors 200, 204.

Because of the configurations and arrangements of the inner and outer rotors 198, 200, 202, 204, the outer rotors 200, 204 are rotated by the inner rotors 198, 202 with a certain lost motion relative to the inner rotors 198, 202. As a result, pumping chambers 260, 262, which volumes vary with the rotations of the pump shaft 196, are formed between the inner and outer rotors 198, 200 and also between the inner and outer rotors 202, 204.

With reference to FIG. 9, the inlet and outlet ports 168, 170 of the feed pump assembly 142 preferably are formed in the front housing member 206 on one side, i.e., on a front side, of the feed pump assembly 142. In other words, the inlet and outlet ports 168, 170 are defined next to one end, i.e., front end, of the inner and outer rotors 198, 200. Similarly but on both sides of the scavenge pump assembly 144, the inlet and outlet ports 174, 176, 178, 180 are formed. That is, the inlet and outlet ports 174, 178 of the scavenge pump assembly 144 preferably are formed in the rear housing member 210 on one side, i.e., on a rear side, of the scavenge pump assembly 142, while the inlet and outlet ports 176, 180 of the scavenge pump assembly 144 are formed in the middle housing member 208 on the other side, i.e., preferably on a front side, of the scavenge pump assembly 142. In other words, the inlet and outlet ports 174, 178 are defined next to one end, i.e., rear end, of the inner and outer rotors 202, 204, while the inlet and outlet ports 176, 180 are defined next to the other end, i.e., front end, of the inner and outer rotors 202, 204.

The inlet and outlet ports 168, 170 of the feed pump assembly 142 are configured as generally the same arcs and do not communicate with each other. When one of the pumping chambers 260 of the feed pump assembly 142 communicates with the inlet port 168 and moves for a while, the volume of the pumping chamber 260 increases and hence lubricant oil is drawn into the pumping chamber 260 through the inlet port 168. Afterwards, when the pumping chamber 260 communicates with the outlet port 170 and moves for a while, the volume of the pumping chamber 260 decreases and hence lubricant oil is pushed out from the pumping chamber 260 through the outlet port 170. Same situations occur with other pumping chambers 260 continuously with the rotation of the pump shaft 196.

In contrast, the respective inlet and outlet ports 174, 176, 178, 180 are configured as generally the same arcs. The inlet and outlet ports 174, 178 do not communicate with each other. Similarly, the inlet and outlet ports 176, 180 do not communicate with each other. When one of the pumping chambers 262 of the scavenge pump assembly 144 communicates with both the inlet ports 176, 174 and moves for a while, the volume of the pumping chamber 262 increases and hence lubricant oil is drawn into the pumping chamber 262 through the inlet ports 174, 176. Afterwards, when the pumping chamber 262 communicates with both the outlet ports 178, 180 and moves for a while, the volume of the pumping chamber 262 decreases and hence lubricant oil is pushed out from the pumping chamber 262 through the outlet ports 178, 180. The same situation occurs with the other pumping chambers 262 continuously with the rotation of the pump shaft 196.

With reference to FIG. 9, the inlet port 168 of the feed pump assembly 142 is connected with the inlet opening 148 without any substantial interconnecting passage. The outlet port 170 of the feed pump assembly 142 also is connected with the outlet opening 152 without any substantial interconnecting passage. The internal scavenge passage 184 that connects the inlet port 174 with the inlet opening 150 is formed within the front, middle, and rear housing members 206, 208, 210 to extend generally in parallel to the axis of the pump shaft 196 out of the feed and scavenge pump assemblies 142, 144. The branch passage 186 is defined within the middle housing member 176 to branch off from the internal scavenge passage 184.

The illustrated branch passage 186 can be formed by drilling from outside of the housing member 208 so that an axis of the branch passage 186 extends generally normal to an axis of the internal scavenge passage 184. A closure plug 270 closes an opening 272 made in the drilling process. The inlet opening 150 thus is positioned oppositely from the pump shaft 196 relative to the inlet opening 148 on the same side of the housing 194 where the housing 194 is mounted on the gear housing 102. This is advantageous because the external conduits or pipes 158, 162 can be as short as possible.

The internal return passage 188 that connects the outlet port 178 with the outlet opening 154 in turn is formed within the front, middle, and rear housing members 206, 208, 210 to extend generally parallel to the axis of the pump shaft 196 out of the feed and scavenge pump assemblies 142, 144. The branch passage 190 is defined within the middle housing member 176 to merge with the internal return passage 188. The illustrated branch passage 190 also can be formed by drilling from outside of the housing member 208 so that an axis of the branch passage 190 extends generally normal to an axis of the internal return passage 188. A closure plug 274 closes an opening 276 made in the drilling process.

As shown in FIG. 10, the respective branch passages 186, 190 preferably cross one another with an angle such as, for example, approximately 60 degrees. The outlet opening 154 thus is positioned oppositely from the pump shaft 196 relative to the outlet opening 170 on the same side of the housing 194 where the housing 194 is mounted on the gear housing 102 as well as the inlet openings 148, 150. That is, all of the inlet and out let openings 148, 150, 152, 154 are formed between the gear housing 102 and the front housing member 206, i.e., the pump housing 194. This is also advantageous because the external conduits or pipes 160, 164 can be as short as possible.

Either the feed or scavenge pump assembly 142, 144 can be positioned adjacent to the gear housing 102. In the illustrated embodiment, the feed pump assembly 142 is advantageously located next to the gear housing 102 because, in general, the feed pump assembly 142 is more important than the scavenge pump assembly 144. That is, a closer location does not need substantial passages that increase flow resistance than the other location and hence the feed pump assembly 142 in this location can be more powerful than the scavenge pump assembly 144.

As described above, in the illustrated embodiment, the scavenge pump assembly 144 has two pairs of inlet and outlet ports 174, 176, 178, 180 on both sides thereof. Because of this arrangement, the lubricant oil can immediately enter the pumping chambers 262 and expand with less delay during filling the entire volume of the respective chambers 262. Accordingly, a relatively large volume of scavenge pump assembly 144 can be applicable. As shown in FIG. 9, the illustrated scavenge pump assembly 144 thus is configured larger than the feed pump assembly 142. That is, a length L1 between both the ends of the inner and outer rotors 202, 204 of the scavenge pump assembly 144 is longer than a length L2 between both the ends of the inner and outer rotors 198, 200. Of course, the scavenge and feed pump spaces 216, 214 have generally the same lengths L1, L2, respectively, to house them therein. Preferably, the length L1 is one and a half times as long as the length L2. Because of this dimensional relationship, the volume of the pumping chambers 262 of the scavenge pump assembly 144 is greater than the volume of the pumping chambers 260 of the feed pump assembly 142. Incidentally, the bearing portion 236 of the in-between housing member 208 preferably has an axial length L3 that is shorter than the length L1 and longer than the length L2.

As the oil pump unit 32 operates along with the operation of the engine 34, the lubricant oil in the oil tank 134 flows through the supply passage 158 and is drawn into the pumping chambers 260 of the feed pump assembly 142 through the inlet opening 148 of the oil pump unit 32 and the inlet port 168 of the feed pump assembly 142. The feed pump assembly 142 feeds the lubricant oil from the pumping chambers 260 to the engine portions 132 through the outlet port 170 of the feed pump assembly 142 and then the outlet opening 152 of the oil pump unit 32 and further through one or more delivery passages 162. The lubricant oil lubricates the engine portions 132 and falls down to the oil cap 138 by its own weight. The lubricant oil in the oil cap 138 then flows through the external scavenge passage 160 and is drawn to the oil pump unit 32 at another inlet opening 150. The lubricant oil then proceeds through the internal scavenge passage 184 to the inlet port 174 of the scavenge pump assembly 144 as indicated by an arrow A of FIG. 9 and then is drawn into the pumping chambers 262.

Simultaneously, a portion of the oil is branched off to the inlet port 176 through the branch passage 186 as indicated by an arrow B of FIG. 9 and is drawn into the pumping chambers 262. The scavenge pump assembly 144 pressurizes the lubricant so as to flow toward the oil tank 134 from the outlet ports 178, 180. The oil in the pumping chambers 262 flows out through both the outlet ports 178, 180 as indicated by arrows C and D of FIG. 9. The lubricant oil from the outlet port 178 proceeds through the internal return passage 188 and the oil from the outlet port 180 goes through the branch passage 190 and then merges with the oil proceeding through the internal return passage 188. The lubricant oil that has passed through the internal return passage 188 flows out to the external return passage 164 from the outlet opening 154. This circulation of the lubricant oil continues as the engine 34 operates.

During the operation of the oil pump unit 32, the rotational speed of the pump shaft 196 varies in response to changes in engine speed, i.e., the rotational speed of the crankshaft 88. The inner and outer rotors 202, 204 of the scavenge pump assembly 144, which are positioned farther from the inlet and outlet openings 150, 154 in this embodiment, also rotate with the rotation of the pump shaft 196. Because it has a larger volume, the scavenge pump assembly 144 provides a desirable flow rate of the return oil to the oil tank 134. Since the pairs of inlet and outlet ports 174, 176, 178, 180 on both the sides of the scavenge pump assembly 144 can have the oil immediately expand to fill the pumping chambers 262 even under a high speed rotational condition of the pump shaft 196, the pump unit 32 provides enhanced oil flow over a larger range of pump shaft 196 speeds. It should be noted that the respective locations of the feed and scavenge pump assemblies within the pump unit are interchangeable with each other.

Figure 12:
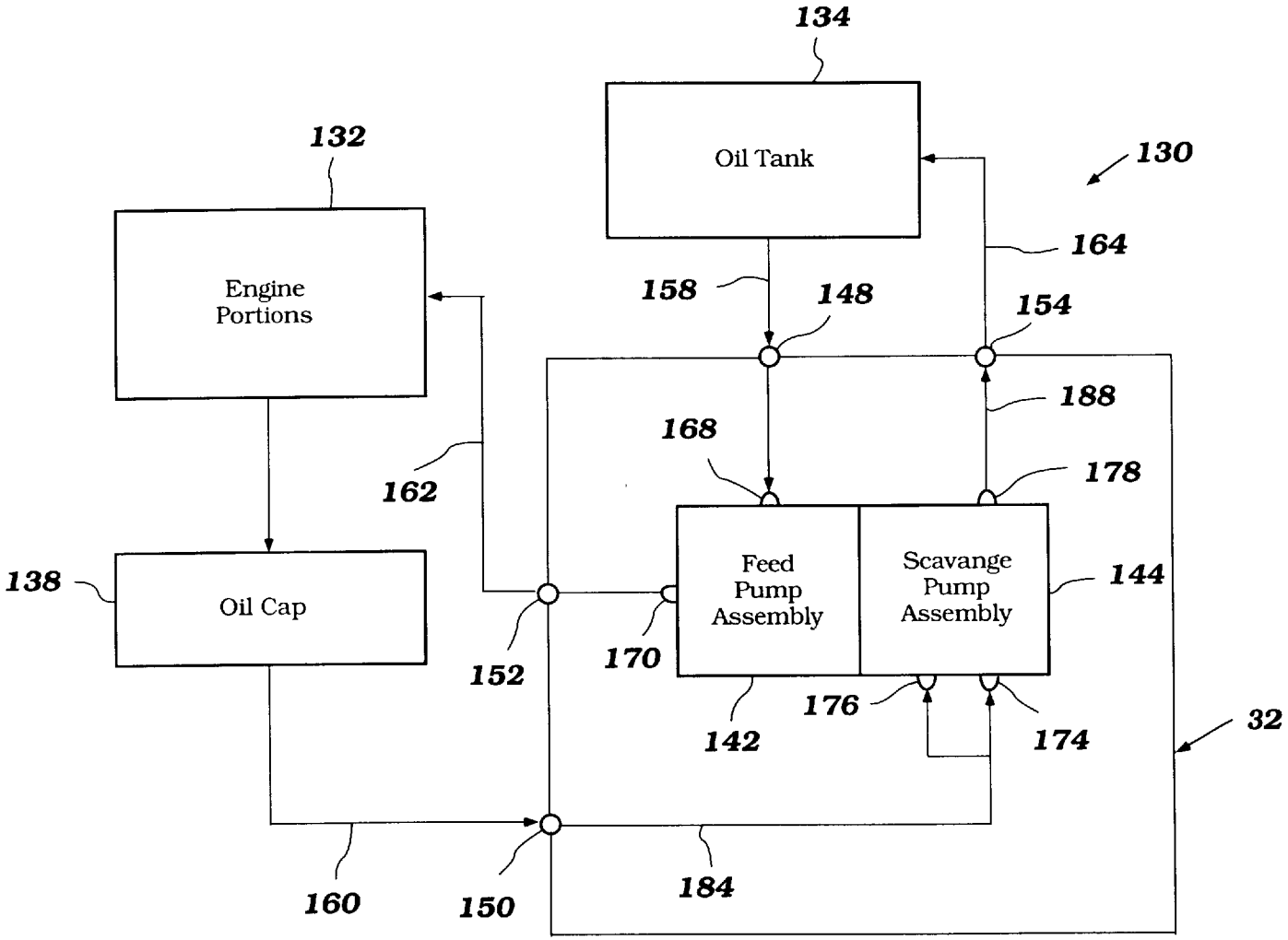
FIG. 12 is a flow chart of a modification of the lubrication system shown in FIG. 8.

The outlet ports 178, 180 of the pump assembly, which is the scavenge pump assembly 144 in the embodiment, are not necessarily a pair on both the sides. FIG. 12 illustrates another embodiment of the oil pump unit 32. The members and components, which have already been described, are assigned with the same reference numerals and will not be described repeatedly.

In this embodiment, the scavenge pump assembly 144 has only one outlet port 178, although both the inlet ports 174, 176 still are provided. This arrangement advantageously expedites the filling of the pumping chambers 262 with lubricant because the lubricant flow out from the chambers 262 is more restricted than the lubricant flow into the chambers 262. It should be noted again that the respective locations of the feed and scavenge pump assemblies within the pump unit are interchangeable with each other in this embodiment. Also, the outlet port 178 can be omitted instead of the outlet port 180. In this alternative, the branch passage 190 of course is a portion of the internal return passage 188.

Figure 13:
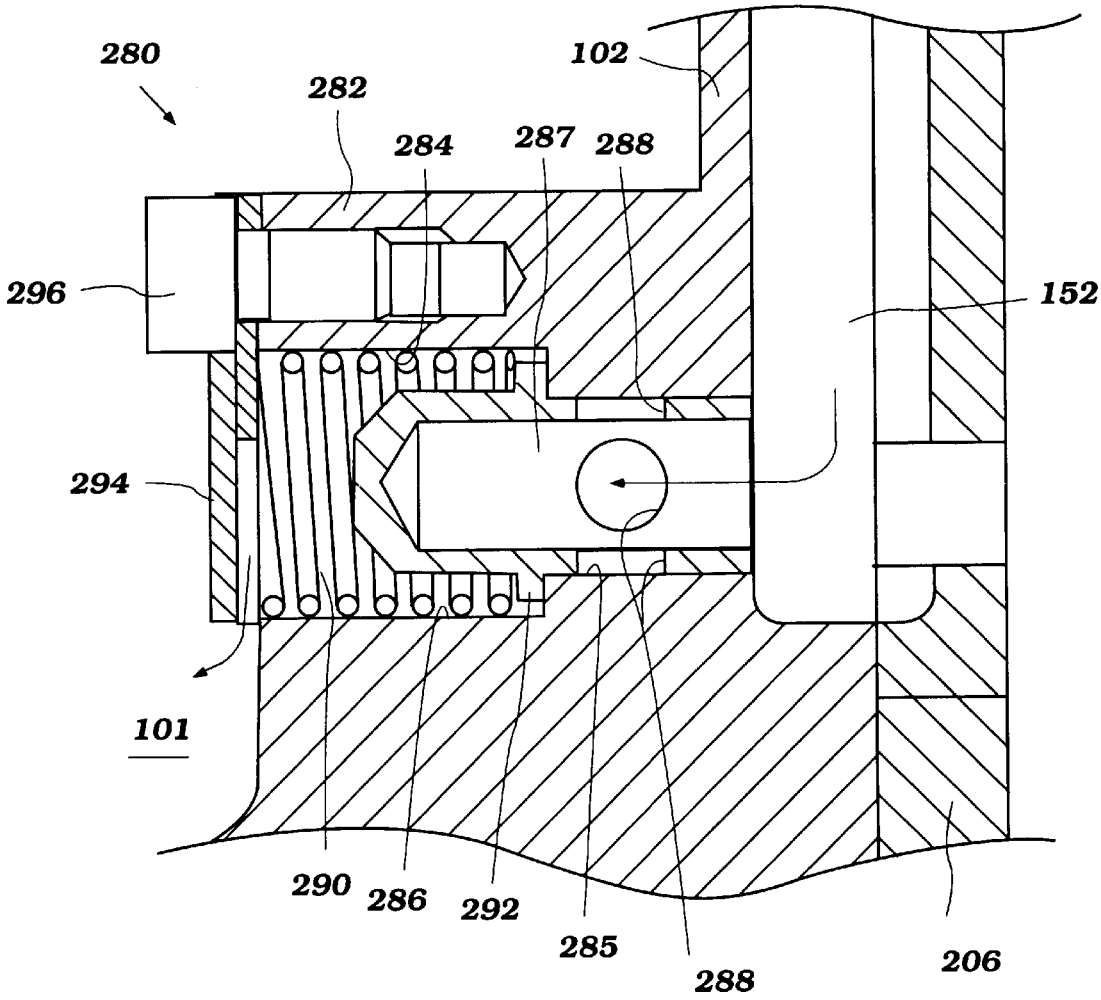
FIG. 13 is a sectional view of a relief valve applied to the feed pump assembly.

With reference to FIG. 13, the oil pump units 32 illustrated in FIGS. 8 and 12, can have a pressure relief construction 280 disposed on a projected portion 282 of the gear housing 102 where the outlet opening 152 of the feed pump assembly 142 is formed. The outlet opening 152 in part is connected with the gear chamber 101 through an aperture 284 defined at the projected portion 282. The aperture 284 comprises a small diameter portion 285 and a large diameter portion 286 that is positioned closer to the gear chamber 101 than the small diameter portion. In other words, the small diameter portion 285 communicates with the outlet opening 152, while the large diameter portion 286 communicates with the gear chamber 101. A relief valve 287 is slideably supported in the small diameter portion 285. The relief valve 287 defines four through-holes 288 that can open to the large diameter portion 286 when the relief valve 287 moves toward the large diameter portion 286, i.e., to an open position. A coil spring 290 is disposed around a tip portion of the relief valve 287 within the large diameter portion 286 of the aperture 284. An end of the spring 290 abuts on a flange portion 292 of the relief valve 287. Another end of the spring 290 abuts on a retainer assembly 294 that is affixed to the projected portion 282 by a bolt 296. The spring 290 thus normally urges the relief valve 287 toward the outlet opening 152 to close the through-holes 288, i.e., to a closed position. The retainer assembly 294 defines a space through which the large diameter portion 286 communicates with the gear chamber 101.

In the event such that the pressure within the feed pump assembly 142 abnormally increases, the relief valve 287 moves to the open position from the closed position against the bias force of the spring 290 to relieve the pressure toward the gear chamber 101. As such, a certain amount of the lubricant oil within the feed pump assembly 142 flows into the gear chamber 101. Afterwards, the spring 290 again biases the relief valve 287 to set it back to the closed position. The gear chamber 101 contains some of the lubricant oil to lubricate the gear train 230. The lubricant oil entering the chamber 101 thus merges with this lubricant oil and then moves to the oil cap 138 anyway.

It should be noted that the scavenge pump assembly instead can have the relief valve at its outlet opening, or both the feed and scavenge pump assemblies can have the relief valve.

Of course, the foregoing description is that of a preferred construction having certain features, aspects and advantages in accordance with the present invention. Various changes and modifications may be made to the above-described arrangements without departing from the spirit and scope of the invention, as defined by the appended claims.

What is claimed is:

1. An oil pump unit for an internal combustion engine comprising a housing, a shaft extending within the housing and journaled thereon for rotation about a shaft axis, the shaft being driven by the engine, a first pump assembly disposed on the shaft to be driven by the shaft, and a second pump assembly disposed on the shaft in series with the first pump assembly to be driven by the shaft, the first and second pump assemblies each defining end portions spaced apart from each other along the shaft axis, the housing defining a first inlet port and at least one outlet port at one of the end portions of the first pump assembly, a second inlet port and a second outlet port at one of the end portions of the second pump assembly, and at least a third inlet port at the other end portion of the second pump assembly.

2. The oil pump unit as set forth in claim 1, wherein the shaft is coupled with an output shaft of the engine at a first location on one side of the housing, and the first pump assembly is disposed next to the first location.

3. The oil pump unit as set forth in claim 1, wherein the housing further defines an inlet passage coupling the second and third inlet ports with each other, and a portion of the inlet passage communicating with the second inlet port is positioned between the first and second pump assemblies.

4. The oil pump unit as set forth in claim 3, wherein the housing still further defines an inlet opening communicating with the inlet passage.

5. The oil pump unit as set forth in claim 4, wherein the inlet opening is formed at a side surface of the housing, and the side surface is positioned closer to the first pump assembly than the second pump assembly.

6. The oil pump unit as set forth in claim 1, wherein the second pump assembly comprises an inner rotor affixed to the shaft to rotate with the shaft and an outer rotor disposed around the inner rotor to be rotated by the inner rotor, the inner and outer rotors together defining at least one pumping chamber, a volume of the pumping chamber varying with rotation of the inner and outer rotors, the second inlet and outlet ports selectively communicating with the pumping chamber with the rotation of the inner and outer rotors.

7. The oil pump unit as set forth in claim 1, wherein a length between the end portions of the second pump assembly is longer than a length between the end portions of the first pump assembly.

8. The oil pump unit as set forth in claim 1, wherein the second pump assembly defines a scavenge pump assembly arranged to collect lubricant oil that has circulated within the engine.

9. The oil pump unit as set forth in claim 8, wherein the first pump assembly defines a feed pump arranged to feed the lubricant oil to the engine.

10. The oil pump unit as set forth in claim 1, wherein the housing defines a third outlet port at the other end portion of the second pump assembly.

11. The oil pump unit as set forth in claim 10, wherein the third inlet and outlet ports selectively communicate with the pumping chamber during rotation of the inner and outer rotors.

12. The oil pump unit as set forth in claim 10, wherein the housing defines an outlet passage coupling the second and third outlet ports with each other, and a portion of the outlet passage communicating with the first outlet port is positioned between the first and second pump assemblies.

13. The oil pump unit as set forth in claim 12, wherein the housing defines an outlet opening communicating with the outlet passage.

14. The oil pump unit as set forth in claim 13, wherein the outlet opening is formed at a side surface of the housing, and the side surface is positioned closer to the first pump assembly than the second pump assembly.

15. The oil pump unit as set forth in claim 1, wherein the engine operates on a four-cycle combustion principle.

16. The oil pump unit as set forth in claim 1, wherein the engine powers a marine propulsion device.

17. A lubrication system for an internal combustion engine comprising a first oil reservoir arranged to contain lubricant oil, a second oil reservoir arranged to receive the lubricant oil that has lubricated portions of the engine, and an oil pump unit arranged to supply the lubricant oil within the first oil reservoir to the portions of the engine and to return the lubricant oil within the second oil reservoir to the first oil reservoir, the oil pump unit comprising a housing, a shaft extending within the housing and journaled thereon for rotation about a shaft axis, the shaft being driven by the engine, a feed pump assembly disposed on the shaft to be driven by the shaft, and a scavenge pump assembly disposed on the shaft in series with the feed pump assembly to be driven by the shaft, the feed and scavenge pump assemblies each defining end portions spaced apart from each other along the shaft axis, the housing defining a first inlet port and a first outlet port at one of the end portions of the feed pump assembly, a second inlet port and a second outlet port at one of the end portions of the scavenge pump assembly, and at least a third inlet port at the other end portion of the scavenge pump assembly.

18. The lubrication system as set forth in claim 17, wherein the first inlet port and the second outlet port are connected to the first oil reservoir, the first outlet port is connected to the portions of the engine, and the second and third inlet ports are connected to the second oil reservoir.

19. The lubrication system as set forth in claim 18, wherein the first outlet port includes a relief valve arranged to allow the lubricant oil in the feed pump assembly to move toward the second oil reservoir when a pressure in the feed pump assembly is greater than a preset pressure.

20. The lubrication system as set forth in claim 17, wherein the shaft is coupled with an output shaft of the engine at a location on one side of the housing, the feed pump assembly is disposed next to the location to extend between the location and the scavenge pump assembly.

21. The lubrication system as set forth in claim 20, wherein the housing an inlet passage coupling the first and second inlet ports with each other, and a portion of the inlet passage communicating with the first inlet port is positioned between the feed and scavenge pump assemblies.

22. The lubrication system as set forth in claim 17, wherein the scavenge pump assembly comprises an inner rotor affixed to the shaft to rotate with the shaft, an outer rotor disposed around the inner rotor to be rotated by the inner rotor, the inner and outer rotors together define at least one pumping chamber, a volume of the pumping chamber varying with rotation of the inner and outer rotors, the second inlet and outlet ports selectively communicating with the pumping chamber with the rotation of the inner and outer rotors.

23. The lubrication system as set forth in claim 17, wherein the housing defines a third outlet port at the other end portion of the scavenge pump assembly.

24. The lubrication system as set forth in claim 23, wherein the third inlet and outlet ports selectively communicate with the pumping chamber during the rotation of the inner and outer rotors.

25. The lubrication system as set forth in claim 17, wherein the first oil reservoir is a primary reservoir of the lubrication system and the second reservoir is a temporary reservoir in the lubrication system.

* * * * *

UNITED STATES PATENT AND TRADEMARK OFFICE

CERTIFICATE OF CORRECTION

PATENT NO. : 6,732,700 B2
DATED : May 11, 2004
INVENTOR(S) : Noboru Suganuma

It is certified that error appears in the above-identified patent and that said Letters Patent is hereby corrected as shown below:

Title page,
Item [*] Notice, please change "bydays.days" to -- by 210 days. --

Signed and Sealed this

Fourteenth Day of September, 2004

JON W. DUDAS
*Director of the United States Patent and Trademark Office*